US009118127B2

(12) United States Patent
Matsunaga et al.

(10) Patent No.: US 9,118,127 B2
(45) Date of Patent: Aug. 25, 2015

(54) CONNECTOR

(71) Applicant: Yazaki Corporation, Minato-ku, Tokyo (JP)

(72) Inventors: Takashi Matsunaga, Makinohara (JP); Miki Suzuki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/300,353

(22) Filed: Jun. 10, 2014

(65) Prior Publication Data

US 2014/0370758 A1 Dec. 18, 2014

(30) Foreign Application Priority Data

Jun. 14, 2013 (JP) ..... 2013-125506

(51) Int. Cl.

| | |
|---|---|
| ***H01R 24/00*** | (2011.01) |
| ***H01R 13/10*** | (2006.01) |
| ***H01R 13/422*** | (2006.01) |
| *H01R 103/00* | (2006.01) |

(52) U.S. Cl.

CPC ..... *H01R 13/10* (2013.01); *H01R 13/4223* (2013.01); *H01R 2103/00* (2013.01)

(58) Field of Classification Search

CPC ..... H01R 13/4365; H01R 13/4223; H01R 13/514; H01R 13/4364; H01R 13/424

USPC ..... 439/626

See application file for complete search history.

(56) References Cited

U.S. PATENT DOCUMENTS

| | | | | |
|---|---|---|---|---|
| 5,820,399 | A * | 10/1998 | Shirouzu et al. | 439/352 |
| 5,820,411 | A * | 10/1998 | Okabe | 439/595 |
| 6,626,701 | B2 * | 9/2003 | Yoshida et al. | 439/595 |
| 8,678,866 | B2 * | 3/2014 | Hiraishi | 439/752 |
| 2003/0157835 | A1 * | 8/2003 | Ishikawa et al. | 439/595 |
| 2012/0034805 | A1 | 2/2012 | Takeda et al. | |

FOREIGN PATENT DOCUMENTS

| | | |
|---|---|---|
| JP | 2012-038549 A | 2/2012 |

* cited by examiner

*Primary Examiner* — Jean F Duverne
(74) *Attorney, Agent, or Firm* — Sughrue Mion, PLLC

(57) ABSTRACT

A connector includes: a housing including terminal accommodating chambers, and lances projecting into the terminal accommodating chambers and capable of withdrawing from the terminal accommodating chambers due to elastic deformation of the lances; terminals inserted into the terminal accommodating chambers and each including a terminal contact part formed on its leading side for contact with a mating terminal and an engagement part foamed for engagement with respective lance and a front holder fitted to a front part of the housing to move between a formal engagement position and a temporary engagement position to hold the terminal contact part. The housing is provided with an opening which exposes engagement points between the lances and the engagement parts in a direction generally perpendicular to an elastically-deformable direction of the lances.

4 Claims, 11 Drawing Sheets

CONNECTOR

CROSS REFERENCE TO RELATED APPLICATION

The present application is based on, and claims priority from, Japan Application Serial Number 2013-125506, filed Jun. 14, 2013, the disclosure of which is hereby incorporated by reference herein in its entirety.

BACKGROUND

1. Technical Field

The present invention relates to a connector including a housing equipped with a lance for engagement with a terminal.

2. Related Art

Conventionally, there are proposed a variety of connectors each including a housing equipped with a lance for engagement with a terminal. One conventional example of such connectors is illustrated in FIG. 12 (refer to JP 2012-038549 A). In the conventional example illustrated in FIG. 12, a connector 100 includes a housing 103 including a terminal accommodating chamber 101 and a lance 102 projecting into the terminal accommodating chamber 101 and also withdrawing from the terminal accommodating chamber 101 due to its own elastic deformation, a terminal 106 inserted into the terminal accommodating chamber 101 and including a terminal contact part 104 formed on its leading end side for contact with a mating terminal (not illustrated) and an engagement part 105 formed for engagement with the lance 102, and a front retainer 107 fitted to a front part of the housing 103 to retain the terminal contact part 104. The housing 103 is formed with a jig insertion hole 109 into which a terminal releasing jig 108 is inserted to release the engagement of the lance 102 with the engagement part 105.

In the above-mentioned constitution, the terminal releasing jig 108 is inserted into the housing 103 through the jig insertion hole 109 of the housing 103. By elastically deforming the lance 102 with the terminal releasing jig 105 inserted into the housing 103, the engagement of the lance 15 with the engagement part 105 of the final 106 is cancelled. In this state, the terminal 106 can be withdrawn backward (leftward in FIG. 12).

SUMMARY

In the conventional connector 100, there is a problem that the terminal 106 cannot be situated in a predetermined releasing position since an engagement point between the lance 102 of the housing 103 and the engagement part 105 of the terminal 106 is not so visible. Additionally, there is a possibility that the terminal releasing jig 108 damages the terminal 106 since the lance 102 is elastically deformed under condition of pressing the terminal releasing jig 108 onto the terminal 106.

In order to solve the above-mentioned problems, therefore, an object of the present invention is to provide a connector which allows a terminal to be detached from a housing easily without damaging the terminal through a terminal releasing jig.

A connector according to an aspect of the present invention includes: a housing including at least one terminal accommodating chamber, and at least one lance projecting into the terminal accommodating chamber and capable of withdrawing from the terminal accommodating chamber due to elastic deformation of the lance; at least one terminal which can be inserted into the terminal accommodating chamber, the terminal having a terminal contact part formed on a leading side thereof for contact with a mating terminal and an engagement part formed for engagement with the lance; and a front holder fitted to a front part of the housing to move between a formal engagement position and a temporary engagement position to hold the terminal contact part. In the process of inserting the terminal into the terminal accommodating chamber, the lance is elastically deformed in a direction to withdraw from the terminal accommodating chamber to allow the terminal to be inserted into the terminal accommodating chamber. In a terminal's position where an insertion of the terminal into the terminal accommodating chamber is completed, the lance is elastically recovered to engage with the engagement part. The housing is provided with an opening which exposes an engagement point between the lance and the engagement part in a direction generally perpendicular to an elastically-deformable direction of the lance.

It is preferable that the opening is opened when the front holder is in the temporary engagement position, while the opening is closed up when the front holder is in the formal engagement position.

The housing may include two juxtaposed terminal accommodating chambers, two lances projecting into the terminal accommodating chambers respectively, and a lance-deformation permissible space defined between the two juxtaposed terminal accommodating chambers and also used for elastic deformation of the two lances for the terminal accommodating chambers. In this case, the terminals are accommodated opposite each other in the two juxtaposed terminal accommodating chambers. Further, the engagement parts of the terminals are shifted from each other in a width direction of the terminal and established in respective positions so that the two lances would not interfere with each other under condition of being deformed elastically.

Preferably, the lance is formed so as to extend in an inserting direction of the terminal, and the opening exposes an engagement point between the lance and the engagement part in a direction generally perpendicular to the lance.

In accordance with the connector according to the aspect of the present invention, since the engagement point between the lance and the engagement part is visible through the opening formed in the housing, it is possible to insert a terminal releasing jig between the lance and the engagement part easily and precisely. Additionally, the insertion of the terminal releasing jig in the direction generally perpendicular to the elastically-deformable direction of the lance and also the elastic deformation of the lance toward the engagement releasing position are visible together. From above, it is possible to easily detach the terminal from the housing without damaging the terminal through the terminal releasing jig.

DETAILED DESCRIPTION

Figure 1:
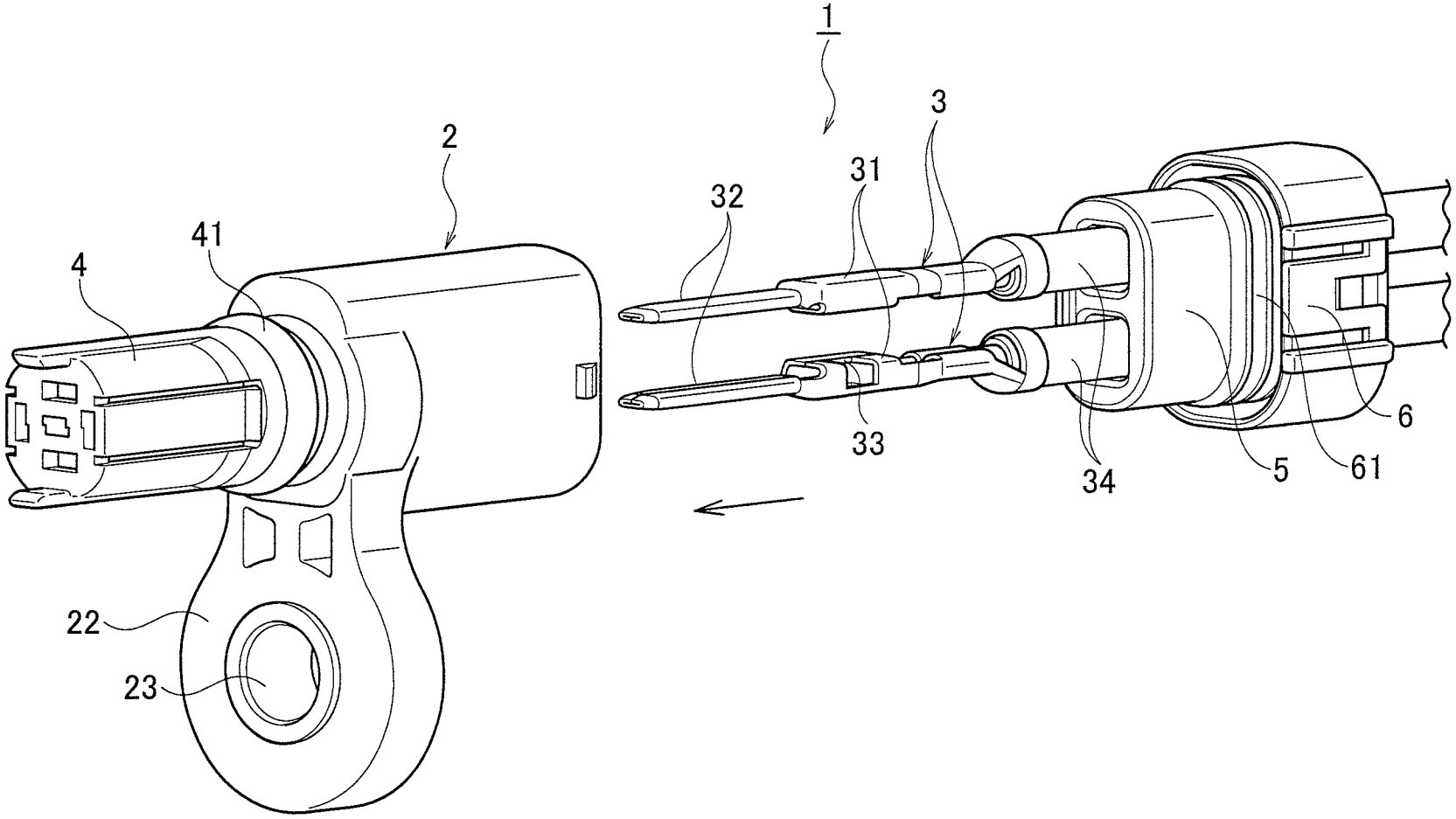
FIG. 1 is an exploded perspective view of a connector according to an embodiment.

An embodiment will be described with reference to drawings below.

FIGS. 1 to 11 illustrate the embodiment. A connector 1 according to the embodiment is a waterproof connector having water resistance and includes a housing 2 and two terminals (crimp male terminals) 3 inserted into the housing 2. A front holder 4 is fitted to a front cylindrical part 21 of the housing 2. A wire spacer 5 and a rear holder 6 are fitted to a rear part of the housing 2.

The front cylindrical part 21 of the housing 2 is inserted into the front holder 4. The front holder 4 is provided to be movable between a formal engagement position and a temporary engagement position for holding terminal contact parts 32. When the front holder 4 is in the formal engagement position, the front cylindrical part 21 is covered by the front holder 4. When the front holder 4 is in the temporary engagement position, the front cylindrical part 21 is exposed. At the base of the front cylindrical part 21, an O-ring 41 is fitted to perform waterproofing between the housing 2 and the front holder 4 and waterproofing between the housing 2 and a mating housing (not illustrated). In the housing 2, a collar 23 is provided on a projection part 22 which projects from the front part of the housing 2 downwardly.

Figure 9:
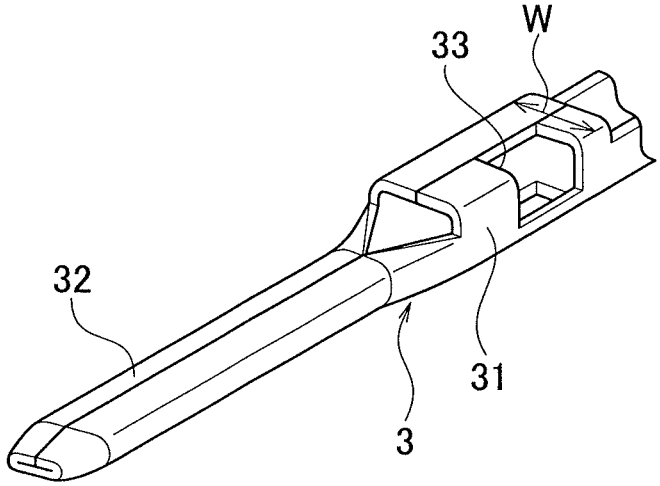
FIG. 9 is a perspective view of an essential part of the terminal for the connector according to the embodiment.

As specifically illustrated in FIGS. 1 and 9, each terminal 3 includes a box part 31 inserted into a terminal accommodating chamber 24 of the housing 2 and a terminal contact part 32 coming into contact with a mating terminal (not illustrated). The box part 31 is formed with an engagement part 33 with which each lance 25 of the housing 2 is engageable. In an arrangement illustrated in FIG. 7, respective engagement parts 33 are shifted from each other in a width direction W of the box part 31 and also established in respective positions so that the two lances 25 would not interfere with each other under condition of being deformed elastically. Correspondingly, two lances 25 are also established in their positions shifted from each other in the width direction W.

Figure 8:
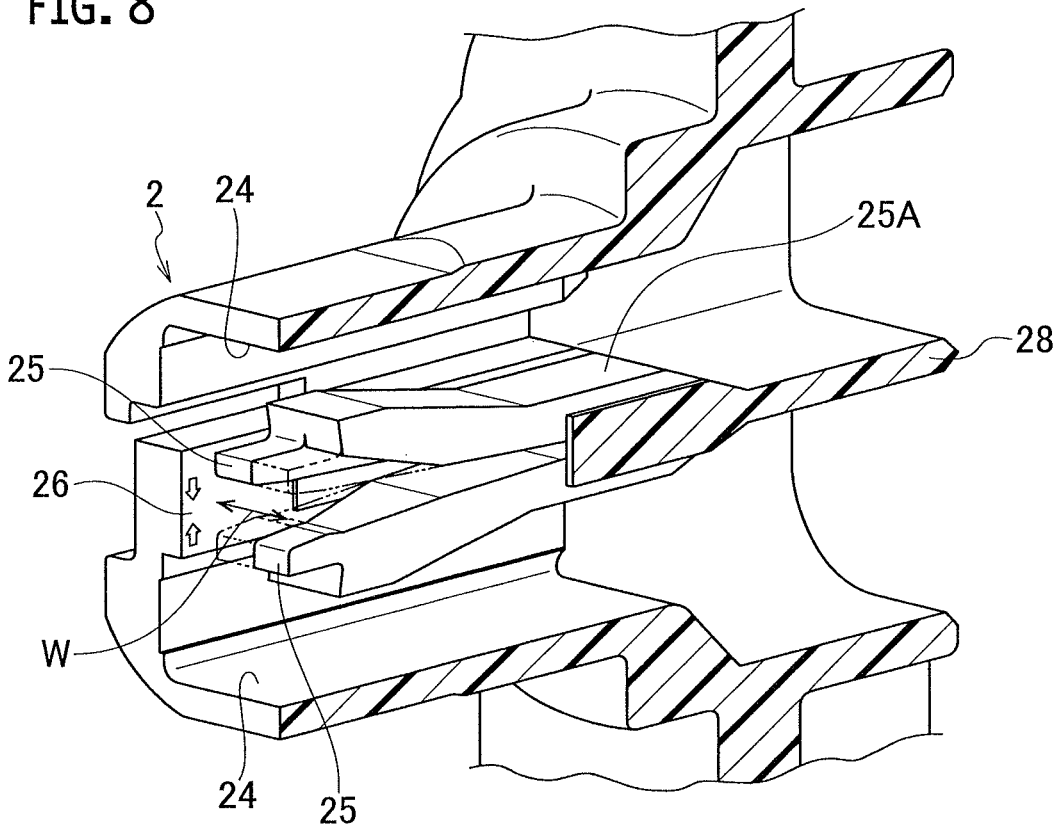
FIG. 8 is a perspective view of an essential part where the housing is partially broken, illustrating the shift positions of two lances in the connector according to the embodiment.

The housing 2 includes two juxtaposed terminal accommodating chambers 24, two lances 25 projecting into the terminal accommodating chambers 24 and capable of withdrawing from the terminal accommodating chambers 24 due to their elastic deformation, and a lance-deformation permissible space 26 disposed between the two juxtaposed terminal accommodating chambers 24 and also used for elastic deformation of the two lances 25 for the respective terminal accommodating chambers 24. As illustrated in FIG. 8, the two lances 25 have respective one ends fixed to a partition wall 28 dividing off two terminal accommodating chambers 24 and respective leading ends diverging from each other, thereby providing each lance 25 with a cantilever-shaped configuration. In the two lances 25, their end portions mutually different in the width direction W are cut out (in FIG. 8, respective cutout positions are illustrated with imaginary lines for clarification.) In this way, the two lances 25 are arranged in positions where they would not interfere with each other under condition of being deformed elastically.

Figure 7:
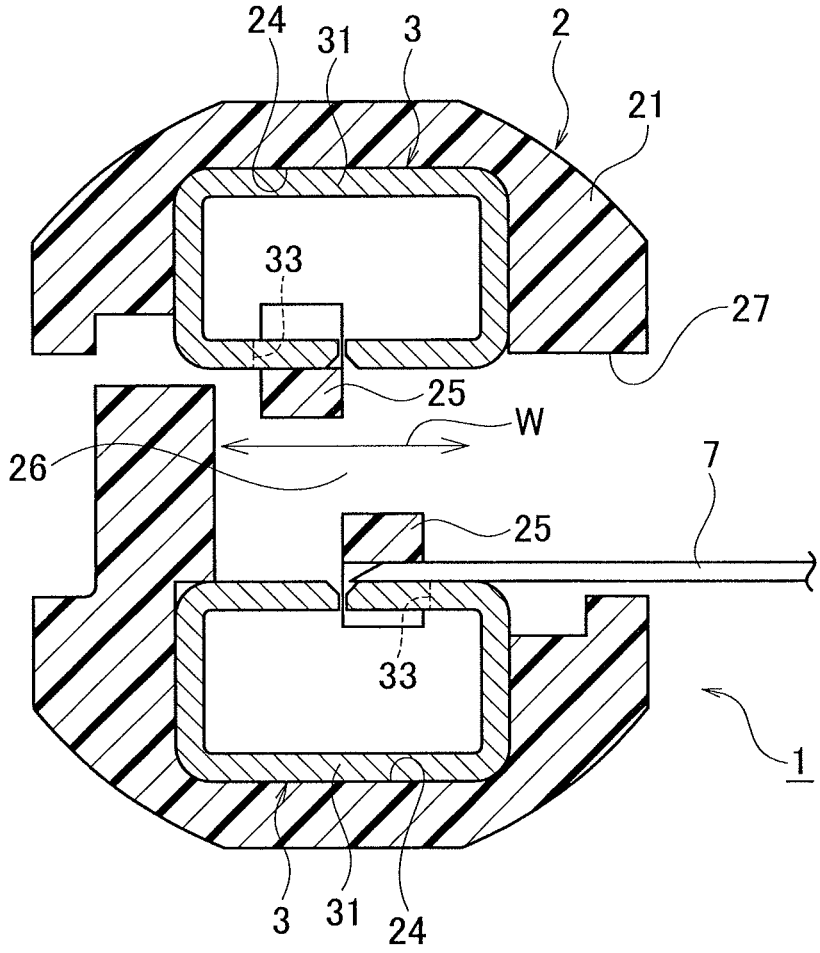
FIG. 7 is a sectional view taken along a line C-C of FIG. 6.

Specifically, as illustrated in FIG. 7, the terminals 7 are accommodated opposite each other in the two juxtaposed terminal accommodating chambers 24, and the engagement parts 33 of the terminals 3 are established in respective positions shifted from each other in the width direction W of the box part 31. Moreover, the two lances 25 are also established in respective position where they would not interfere with each other under condition of being deformed elastically.

Figure 2:
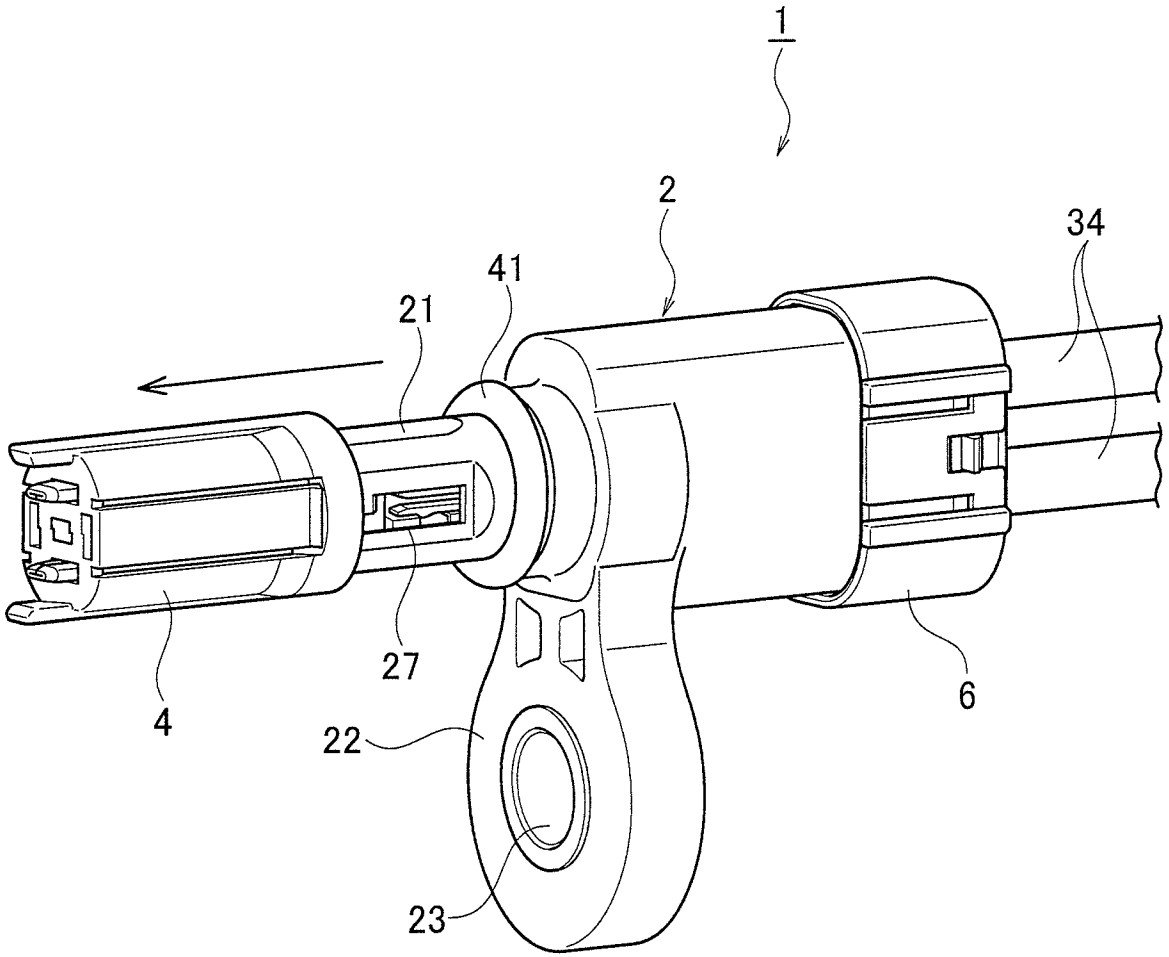
FIG. 2 is a perspective view of the connector according to the embodiment, illustrating a state where insertion of terminals is completed.
Figure 3A:
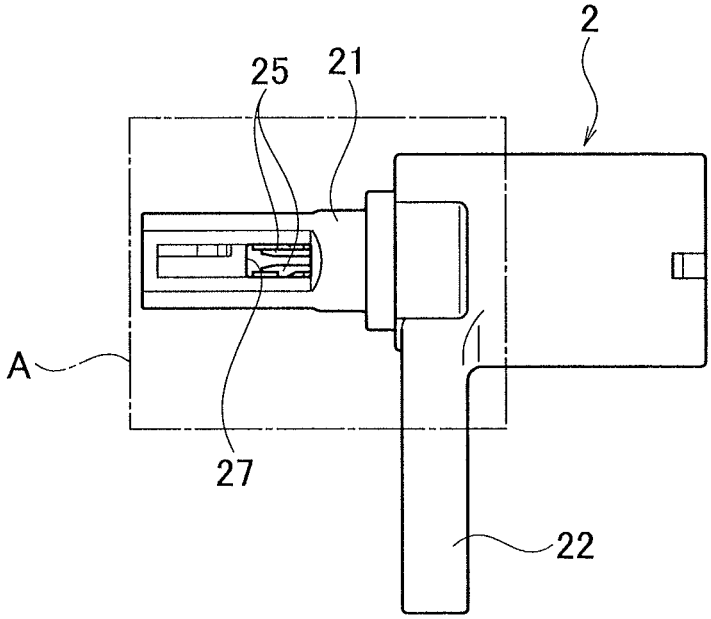
FIG. 3A is a side view of a housing of the connector according to the embodiment.
Figure 3B:
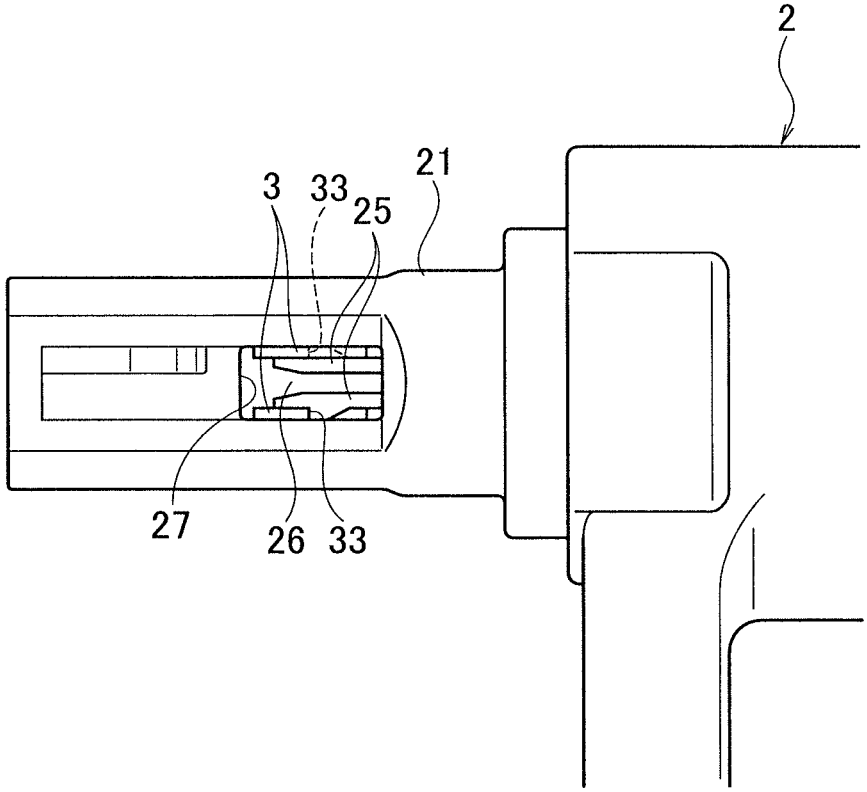
FIG. 3B is an enlarged side view of a part A of FIG. 3A.

In the front cylindrical part 21 of the housing 2, an opening 27 is formed so as to expose the engagement points between the lances 25 and the engagement parts 33 in a direction generally perpendicular to the elastically-deformable direction of the lances 25 (on the side of a plane along the elastic deformation of the lances 25). The opening 27 is arranged so as to open when the front holder 4 is in the temporary engagement position as illustrated in FIG. 2 etc., and close up when the front holder 4 is in the formal engagement position as illustrated in FIG. 1 etc. Through the opening 27, the engagement points between the lances 23 and the engagement parts 33 are exposed in the direction generally perpendicular to the lances 25 extending in the inserting direction of the terminals 3.

The wire spacer 5 fitted to the rear part of the housing 2 is held by the rear holder 6. Wires 34 connected to the terminals 3 are inserted into the wire spacer 5 and the rear holder 6. In the rear holder 6, an O-ring 61 is arranged to perform waterproofing between the housing 2 and the rear holder 6 and waterproofing between the wires 34 and the rear holder 6.

Figure 4:
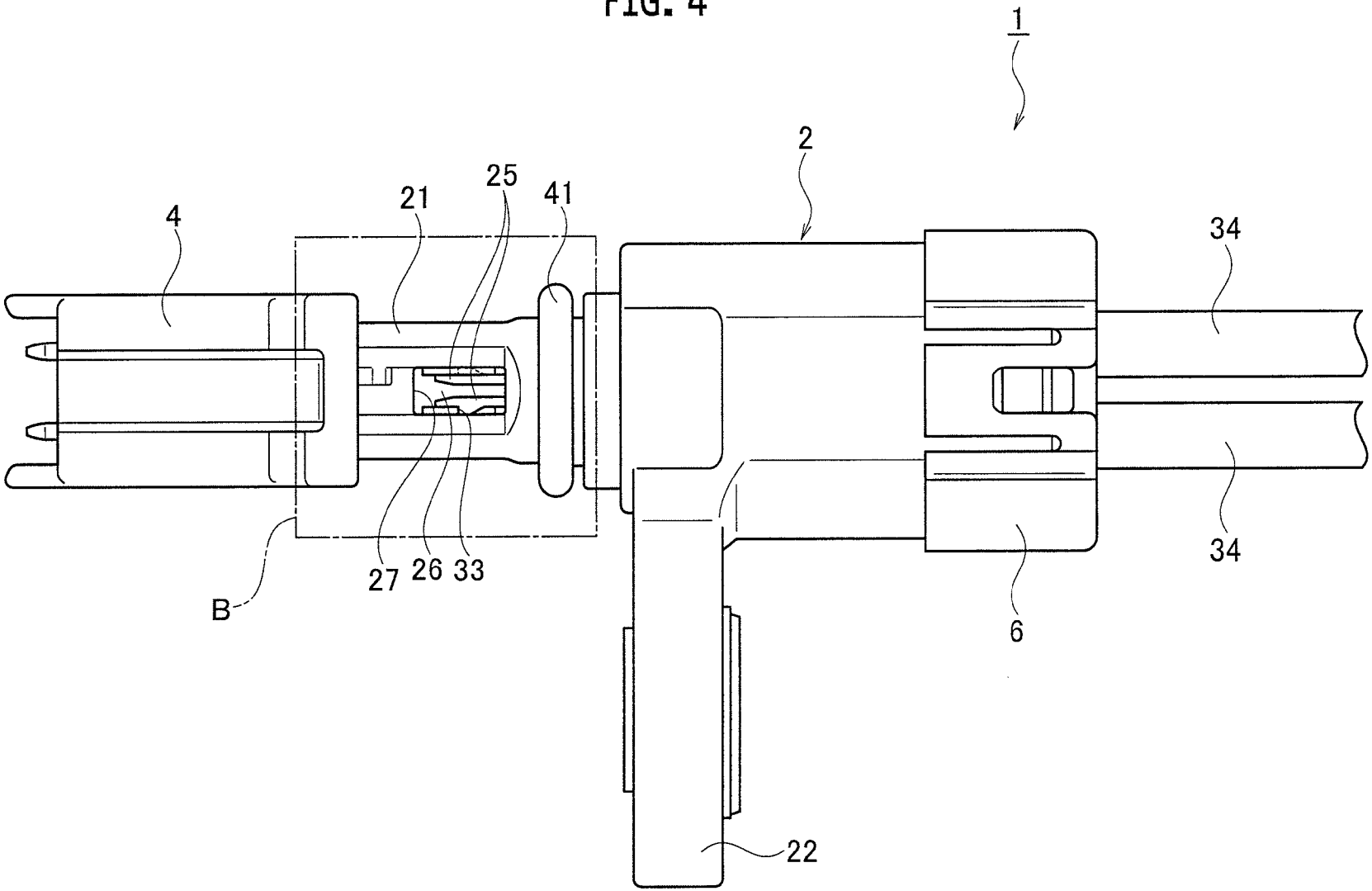
FIG. 4 is a side view of the connector according to the embodiment, illustrating the state where the insertion of the terminals is completed.
Figure 5:
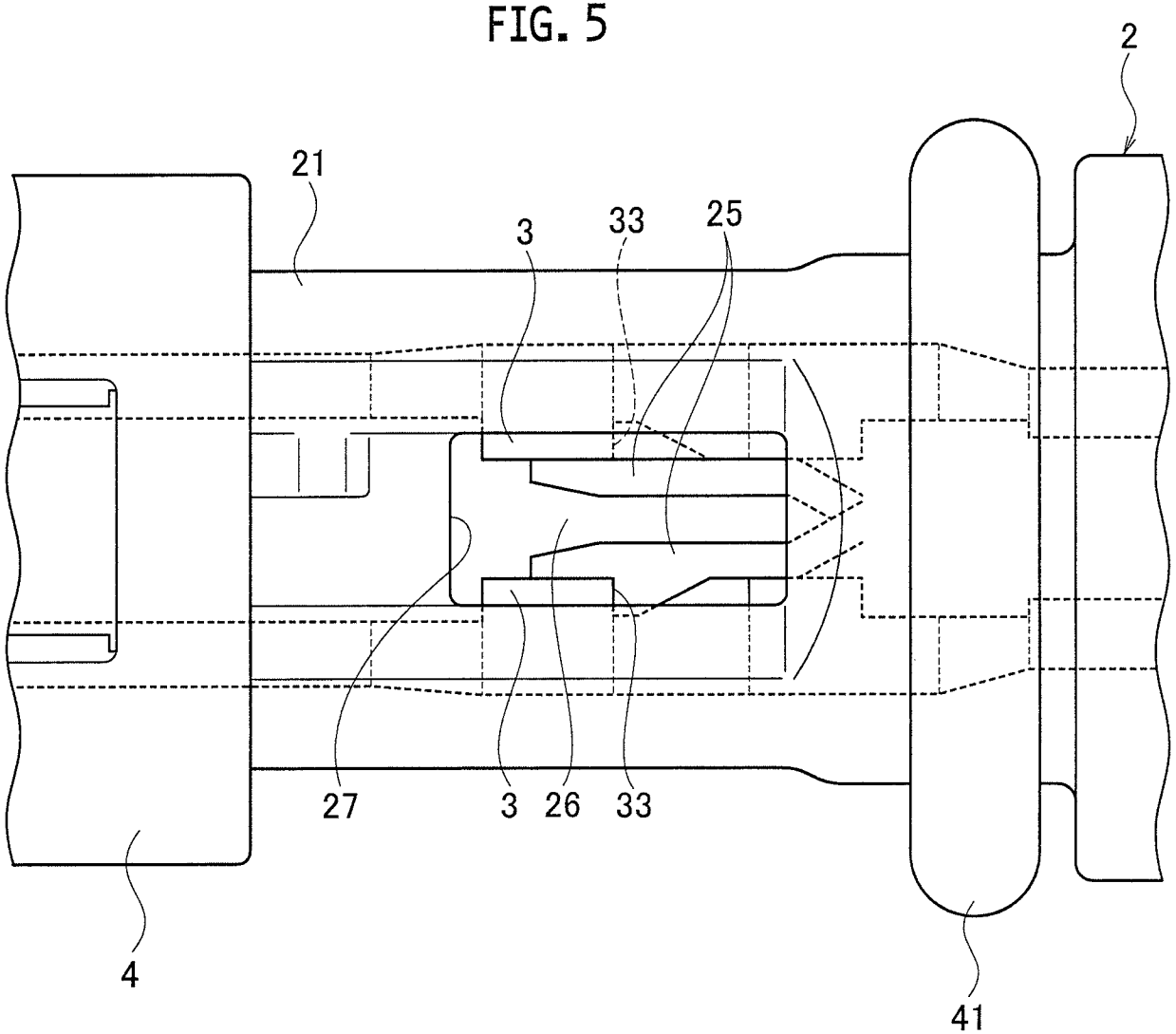
FIG. 5 is an enlarged side view of a part B of FIG. 4.
Figure 10:
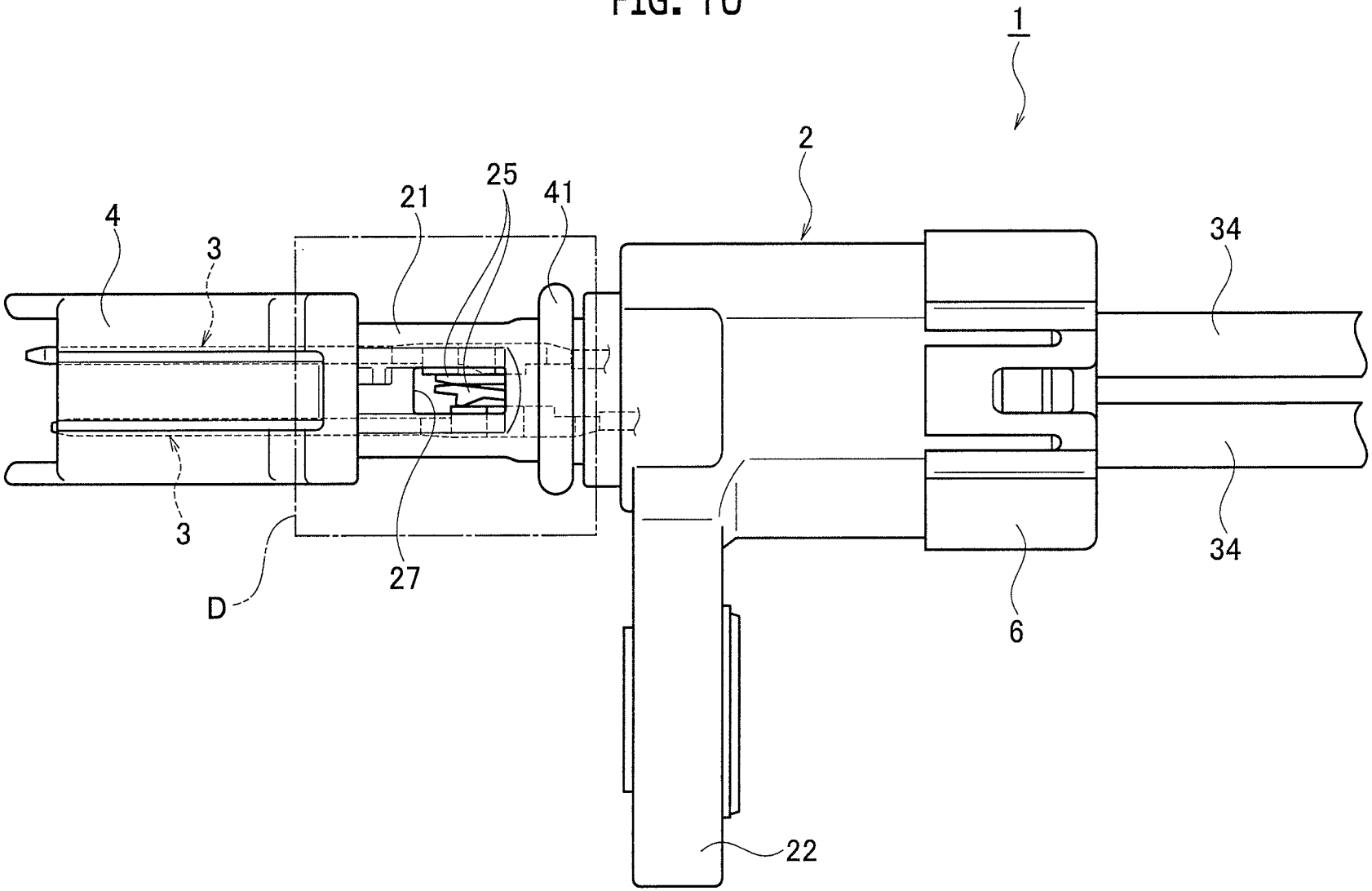
FIG. 10 is side view of the connector according to the embodiment, illustrating one terminal in a complete inserting position and the other terminal in an incomplete inserting position.
Figure 11:
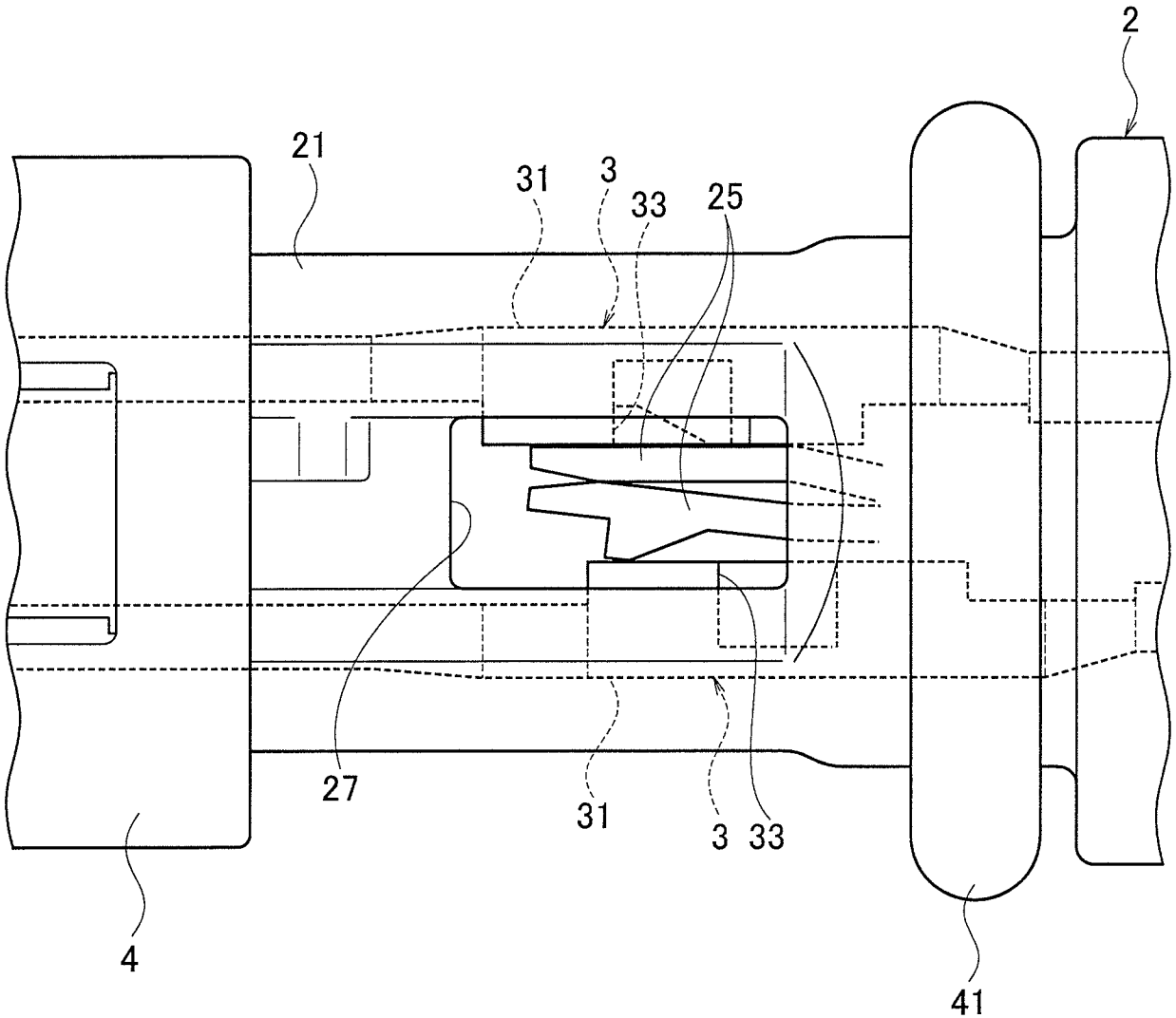
FIG. 11 is an enlarged side view of a part D of FIG. 10.
Figure 12:
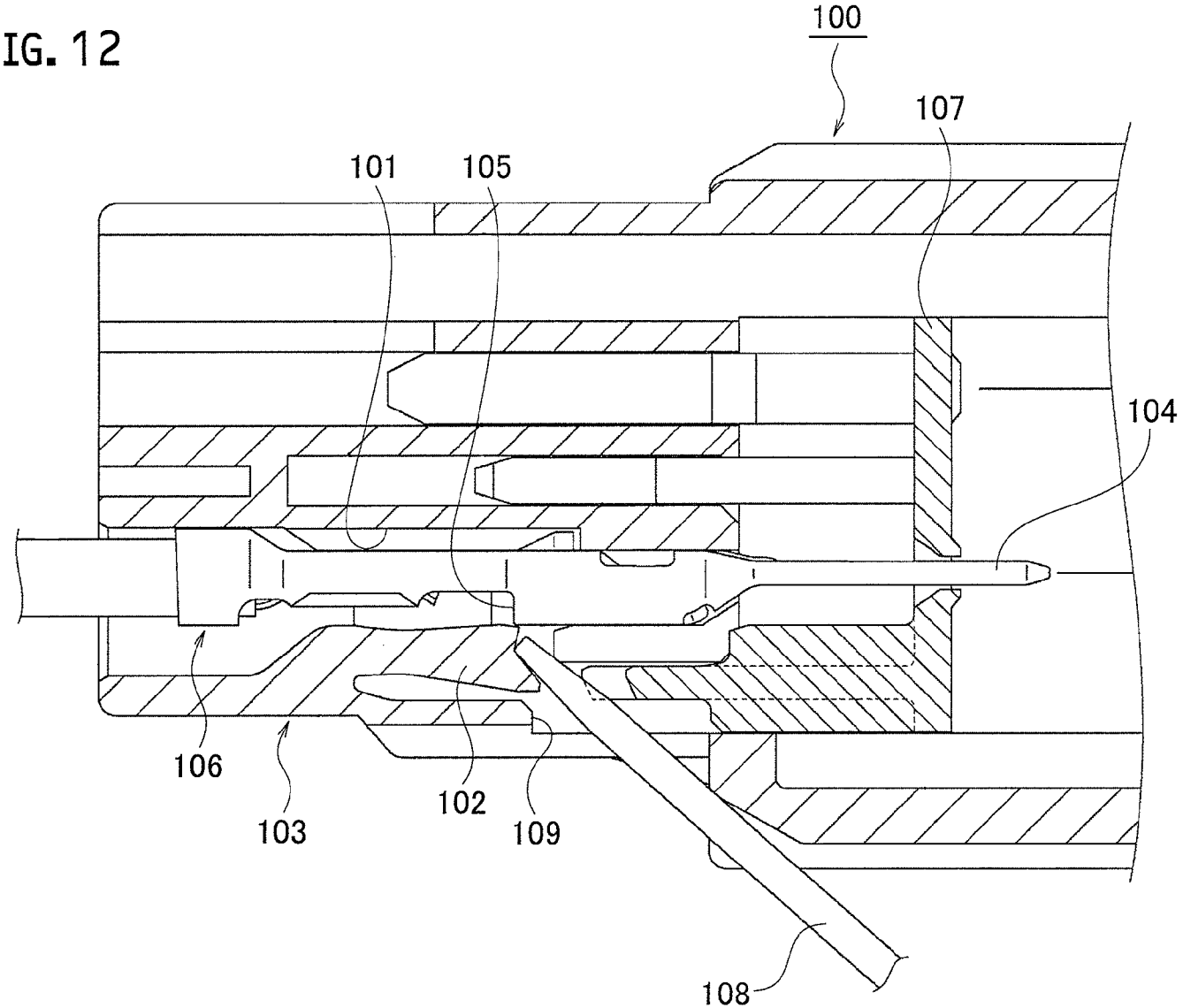
FIG. 12 is a sectional view of a conventional connector.

In the above-mentioned constitution, when the terminals 3 are inserted into the terminal accommodating chambers 24 through the rear end of the housing 2 under a condition that the front holder 4 is set in the formal engagement position as illustrated in FIG. 1, the lances 25 are pressed by the terminals 3. As a result, the lances 25 are elastically deformed in the directions to withdraw from the terminal accommodating chambers 24, so that the insertion of the terminals 3 is permitted. On a way of the insertion process of the terminals 3, as illustrated in FIGS. 10 and 11, the lance 25 corresponding to one terminal 3 inserted completely is elastically recovered to engage with the engagement part 33, while the lance 25 corresponding to the other terminal 3 on the way of the insertion process is elastically deformed in the direction to withdraw from the terminal accommodating chamber 24. Next, when the other terminal 3 is inserted further, it reaches its insertion completion position, so that both of the lances 25 are elastically recovered to engage with the engagement parts 33, as illustrated in FIGS. 4 and 5.

Under the condition that both of the terminals 3 are inserted completely in the above way, when the front holder 4 is displaced to the temporary engagement position, then the engagement points between the lances 25 and the engagement parts 33 are exposed in the direction generally perpendicular to the elastically-deformable directions of the lances 25 through the opening 27 in the front cylindrical part 21 of the housing 2.

Figure 6:
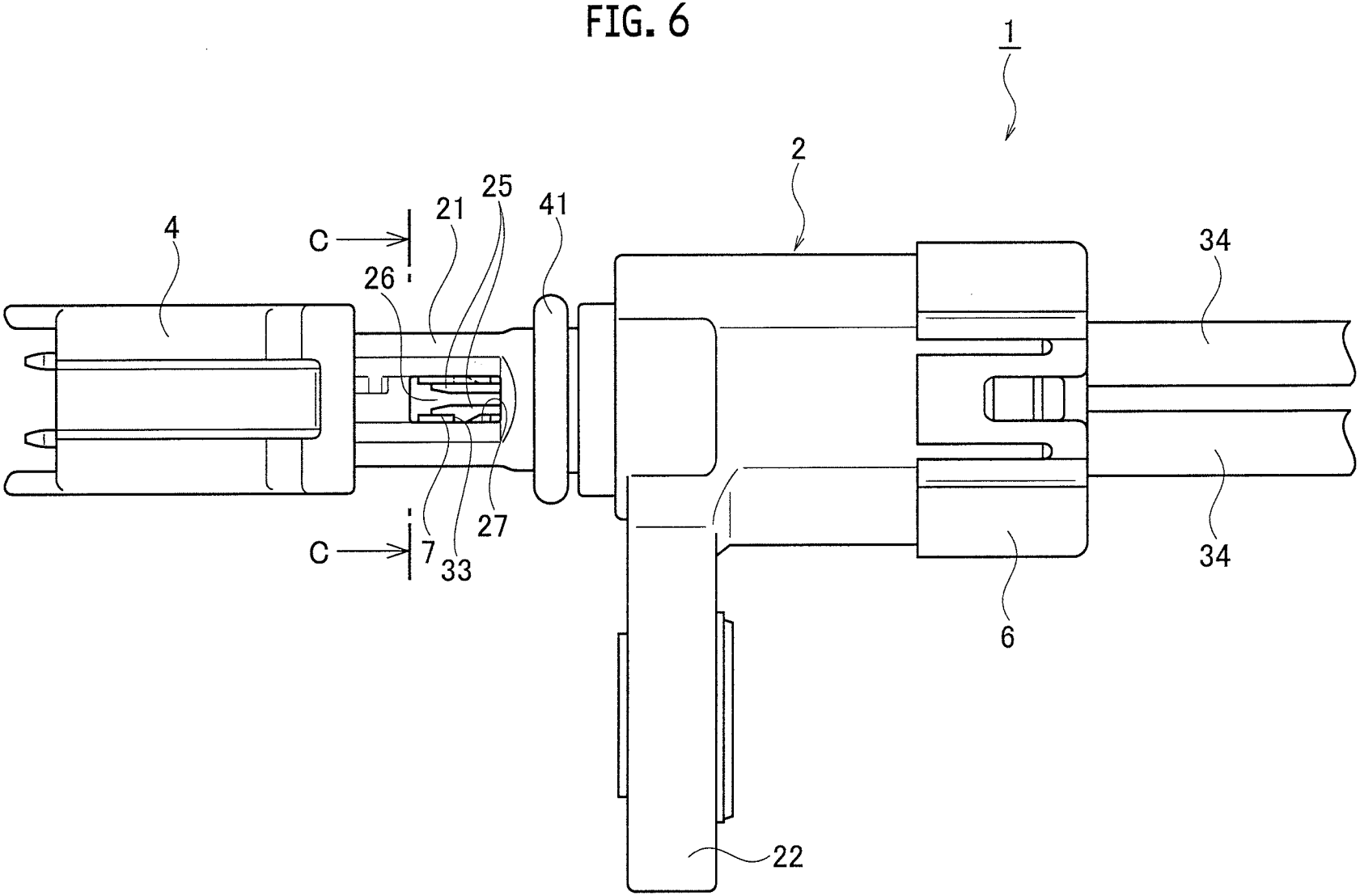
FIG. 6 is a side view of the connector according to the embodiment, illustrating a state where a terminal releasing jig is being inserted.

Next, when extracting the completely-inserted terminals 2 from the housing 2, the front holder 4 is set in the temporary engagement position, as illustrated in FIGS. 6 and 7. On that basis, a terminal releasing jig 7 is inserted toward the engagement point between the lance 25 and the engagement part 33 through the opening 27 of the housing 2. Then, by the terminal releasing jig 7, the lance 25 is elastically deformed in the direction to withdraw from the terminal accommodating chamber 24, releasing the lance 25 in the engaged state. Under such a situation, the terminal 3 is extracted from the housing 2 rearward. At this time, as the terminal contact part 32 of the terminal 3 is protected by the front holder 4, it is possible to prevent the terminal contact part 32 from being damaged by an external force.

As mentioned above, the engagement points between the lances 25 and the engagement parts 33 are visible through the opening 27 of the housing 2. Therefore, it is possible to insert the terminal releasing jig 7 between the lance 5 and the engagement part 33 easily and precisely. Moreover, the insertion of the terminal releasing jig 7 in the direction generally perpendicular to the elastically-deformable direction of the lance 25 and also the elastic deformation of the lance 25 toward the engagement releasing position are visible together. From this reason, it is possible to easily detach the terminals 3 from the housing 2 without damaging the terminals 3 through the terminal releasing jig 7.

When the front holder 4 is in the formal engagement position, the opening 27 of the housing 2 is closed up. Consequently, it is possible to prevent foreign substances, such as water, from entering the housing 2 through the opening 27.

The two lances 25 projecting into the two juxtaposed terminal accommodating chambers 24 are established in respective positions shifted from each other in the width direction W of the box 31 and also in their positions where the lances 25 would not interfere with each other even when they are deformed elastically. For this reason, even if the lance-deformation permissible space 26 is defined with a breadth allowing an elastic deformation of only one lance 25, such a housing allows the two lances 25 to be simultaneously deformed in the direction to withdraw from the terminal accommodating chambers 24 with no risk of interference. From above, it is possible to release the terminals 3 without increasing the breadth of the housing 2.

The terminal releasing jig 7, which has been inserted toward the engagement points between the lances 25 and the engagement parts 33 in the direction generally perpendicular to the lances 25 through the opening 27 of the housing 2, is directed toward only the engagement part 33 of the terminal 3 with no need for engaging with the other portions of the terminal 3. Therefore, it is possible to suppress the damage on the terminal 3 to the utmost extent.

What is claimed is:

1. A connector, comprising:

a housing comprising at least one terminal accommodating chamber, and at least one lance projecting into the terminal accommodating chamber and capable of withdrawing from the terminal accommodating chamber due to elastic deformation of the lance;

at least one terminal which can be inserted into the terminal accommodating chamber, the terminal having a terminal contact part formed on a leading side thereof for contact with a mating terminal and an engagement part formed for engagement with the lance; and a front holder fitted to a front part of the housing to move between a formal engagement position and a temporary engagement position to hold the terminal contact part, wherein in the process of inserting the terminal into the terminal accommodating chamber, the lance is elastically deformed in a direction to withdraw from the terminal accommodating chamber to allow the terminal to be inserted into the terminal accommodating chamber, in a terminal's position where an insertion of the terminal into the terminal accommodating chamber is completed, the lance is elastically recovered to engage with the engagement part, and the housing is provided with an opening which exposes an engagement point between the lance and the engagement part in a direction generally perpendicular to an elastically-deformable direction of the lance.

2. The connector according to claim 1, wherein the opening is opened when the front holder is in the temporary engagement position, while the opening is closed up when the front holder is in the formal engagement position.

3. The connector according to claim 1, wherein the housing comprises two juxtaposed terminal accommodating chambers, two lances projecting into the terminal accommodating chambers respectively, and a lance-deformation permissible space defined between the two juxtaposed terminal accommodating chambers and also used for elastic deformation of the two lances for the terminal accommodating chambers, the terminals are accommodated opposite each other in the two juxtaposed terminal accommodating chambers, and the engagement parts of the terminals are shifted from each other in a width direction of the terminal and established in respective positions so that the two lances would not interfere with each other under condition of being deformed elastically.

4. The connector according to claim 1, wherein the lance is formed so as to extend in an inserting direction of the terminal, and the opening exposes an engagement point between the lance and the engagement part in a direction generally perpendicular to the lance.

* * * * *